United States Patent [19]

Arimitsu

[11] 4,099,479

[45] Jul. 11, 1978

[54] OUTBOARD MARINE PROPULSION UNIT

[75] Inventor: Tetsuya Arimitsu, Iwata, Japan

[73] Assignees: Sanshin Kogyo Kabushiki Kaisha; Yamaha Hatsudoki Kabushiki Kaisha, both of Japan

[21] Appl. No.: 772,252

[22] Filed: Feb. 25, 1977

[30] Foreign Application Priority Data

Feb. 25, 1976 [JP] Japan ..... 51-19683

[51] Int. Cl.[2] ..... B63H 21/26

[52] U.S. Cl. ..... 115/41 R; 248/4

[58] Field of Search ..... 115/17, 41 R, 41 H, 115/41 T; 248/4

[56] References Cited

U.S. PATENT DOCUMENTS

| | | | |
|---|---|---|---|
| 3,666,218 | 5/1972 | Hagen | 248/4 |
| 3,785,329 | 1/1974 | Shimanckas | 115/41 R |
| 4,013,249 | 3/1977 | Meyer et al. | 115/17 X |

*Primary Examiner*—Trygve M. Blix
*Assistant Examiner*—Sherman D. Basinger
*Attorney, Agent, or Firm*—Cameron, Kerkam, Sutton, Stowell & Stowell

[57] ABSTRACT

An outboard marine propulsion unit comprising a clamp bracket and a swivel bracket which is pivotably mounted on the clamp bracket and supporting a driving assembly. A reverse lock mechanism and a tilt lock mechanism are provided. The tilt lock mechanism is so constructed that, after an operating lever is shifted, the driving assembly can be raised to a tilted position where it is automatically locked.

10 Claims, 7 Drawing Figures

OUTBOARD MARINE PROPULSION UNIT

The present invention relates to outboard marine propulsion units and more particularly to tilt lock means for holding such outboard marine propulsion units in a position raised or elevated relative to a normal position.

Conventionally, outboard marine propulsion units are mounted on the transom of a boat hull for swivel movement so that the units can be moved to a raised position and tilt lock means is provided for holding the units in the raised position. In conventional outboard propulsion units, the tilt lock means has been constructed in such a manner that the propulsion unit must be held by hand or other suitable means against the weight of the unit when the tilt lock means is being actuated for locking or releasing the unit.

The U.S. Pat. No. 3,785,329 issued to William J. Shimankas and entitled as "Combined Reverse Lock and Swivel Bracket Holding Mechanism" discloses a mechanism for stern drive outboard units by which the unit can be locked in a raised position automatically when the unit is moved by a predetermined distance so that the aforementioned inconveniency can be eliminated. The tilt lock or swivel bracket holding mechanism of the patent is associated with a so called reverse lock mechanism which holds the unit in a normal running position against a reverse thrust. The holding or reverse lock mechanism is so constructed that when the unit is subjected to a reverse thrust exceeding a predetermined value the mechanism is overridden by the thrust and the unit is moved upwards from the normal running position.

The arrangement is considered as being advantageous in that the propulsion unit is protected in operation against possible damage when the unit collides with a heavy floating obstacle such as a log. The arrangement as proposed in the patent is so constructed that the spring in the reverse lock mechanism also serves to apply locking and releasing biasing force to the locking bracket in the tilt lock mechanism. The arrangement is disadvantageous in that, since an adequate distance cannot be provided between the line of spring force and the pivot axis of the locking bracket, the spring in the reverse lock mechanism must be of a substantial strength. However, from the viewpoint of the reverse lock function, the spring load must not be too strong. Therefore, it is practically very difficult to obtain an optimum spring tension.

Further, in the arrangement proposed by the patent, the operating lever must be provided with its pivot axis coaxial with the pivot axis of the locking bracket in the tilt lock mechanism which is located outside the boat hull. Thus, inconveniences will be encountered in actuating the operating lever by a person standing on the stern of the boat. Further, the operating lever must be rotated more than 120 degrees of travel from the normal operating position to the position where the tilt lock mechanism is operable.

The present invention has therefore an object to provide outboard marine propulsion units with tilt lock means in which the aforementioned disadvantages are eliminated.

Another object of the present invention is to provide tilt lock means for outboard marine propulsion units in which means is provided for disabling the tilt lock means in a normal operating position.

A further object of the present invention is to provide tilt lock means for outboard marine propulsion units which is convenient for operation.

According to the present invention, the above and other objects can be accomplished by an outboard marine propulsion unit comprising clamp bracket means adapted to be secured to a boat hull, swivel bracket means pivotably mounted about an axis on said clamp bracket means and carrying a driving assembly, tilt lock means for holding said swivel bracket means in a position raised with respect to a normal operating position, said tilt lock means including locking member means pivotably mounted on one of the clamp bracket means and the swivel bracket means and having elongated slot means, said slot means being formed at one end with locking recess means offset to one side of the slot means, locking pin means provided on the other of said clamp bracket means and said swivel bracket means and slidably engaging said slot means, means for biasing said locking member means in such a direction that the locking recess means is forced into engagement with the locking pin means when the swivel bracket means is moved to the raised position and the locking pin means is slidably moved along the slot means to the end where the locking recess means is formed, restricting means adapted to engage said locking member means for restricting said locking member means against the movement under the biasing means, and control means for moving said restricting means into and from a position where the restricting means is engageable with said locking member means.

The propulsion unit in accordance with the present invention may further include reverse lock means for holding the swivel bracket means in the normal operating position against the reverse thrust. The reverse lock means may be so formed that it is overridden by an excessively high reverse thrust.

The above and other objects and features of the present invention will become apparent from the following descriptions of a preferred embodiment taking reference to the accompanying drawings, in which.

Figure 1:
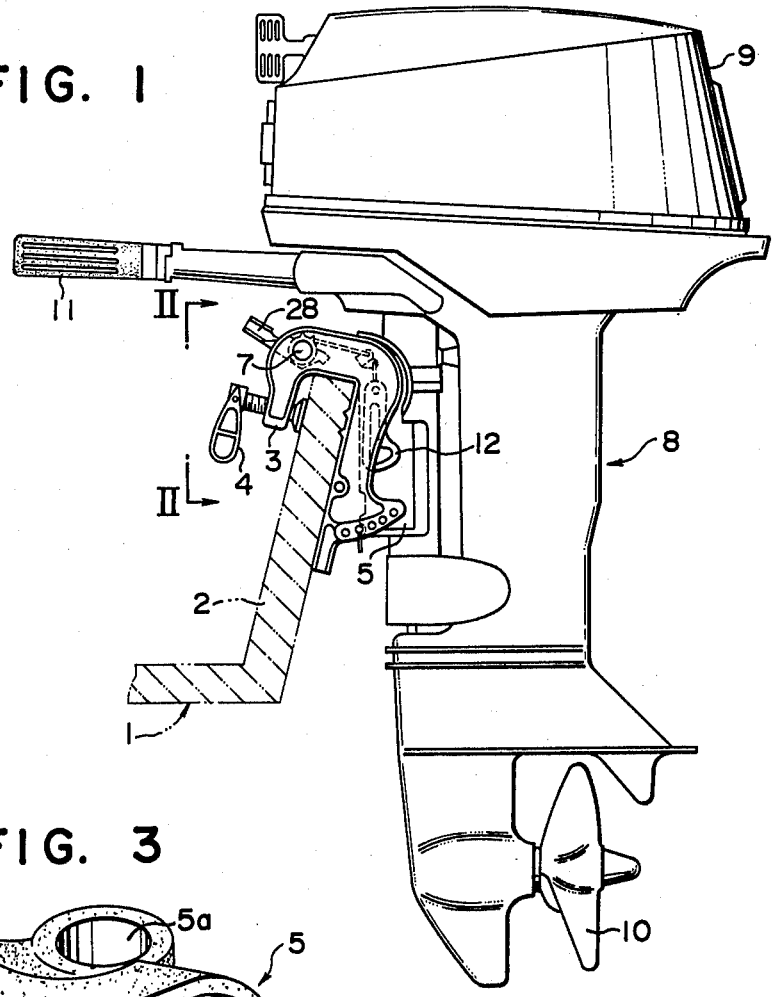
FIG. 1 is a side elevational view of an outboard marine propulsion unit in accordance with one embodiment of the present invention.
Figure 3:
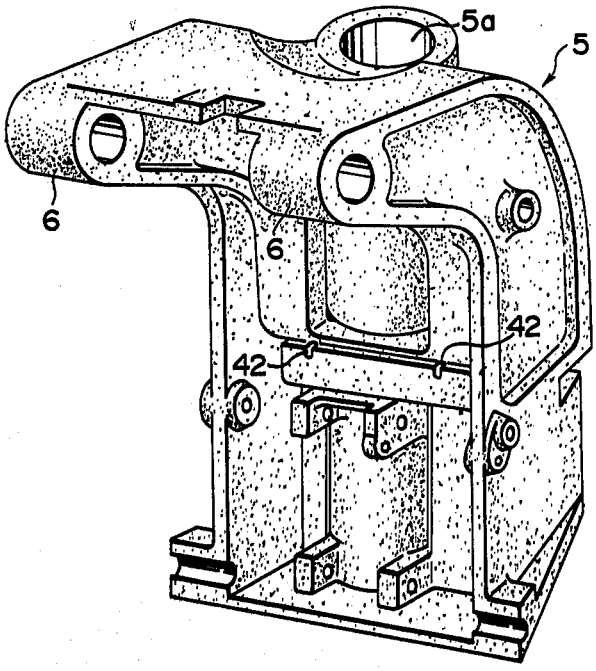
FIG. 3 is a perspective view of the swivel bracket used in the unit.
Figure 2:
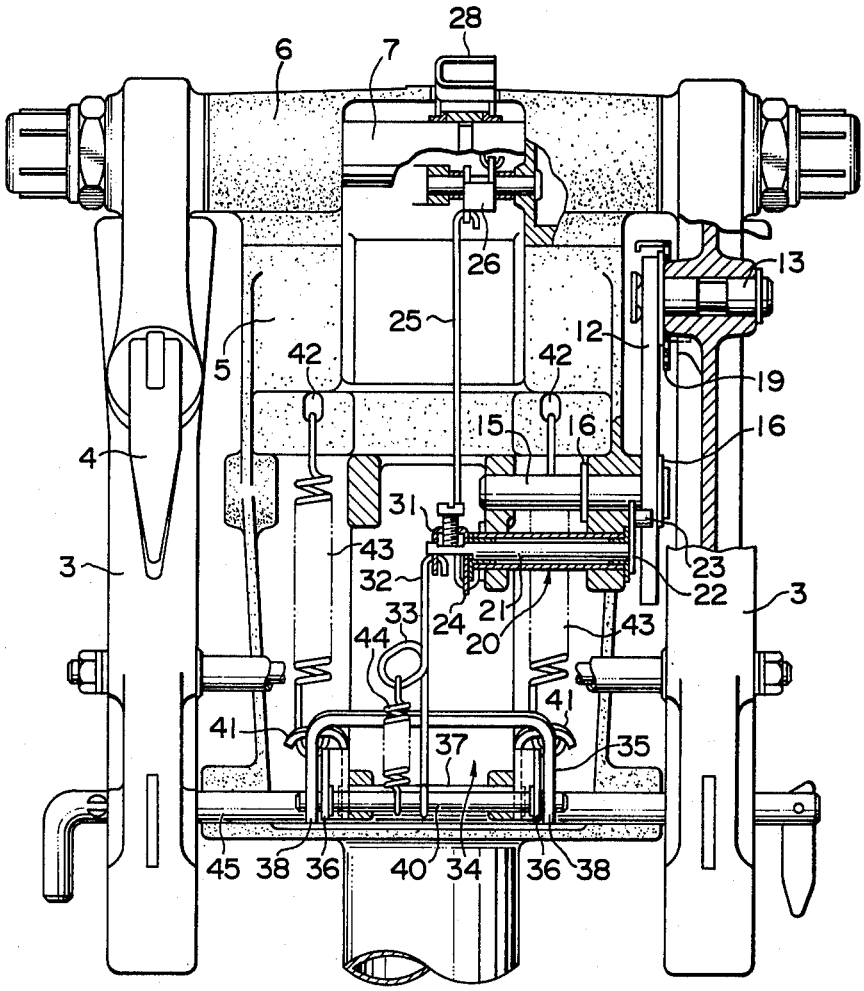
FIG. 2 is a view along the line II—II in FIG. 1 and as seen in the direction of arrows.

Referring now to the drawings, particularly to FIGS. 1 through 3, the outboard marine propulsion unit shown therein includes a clamp bracket 3 which is adapted to be secured by means of clamping screws 4 to the transom 2 of a boat hull 1. A swivel bracket 5 is mounted on the clamp bracket 3 pivotably by means of a horizontal pin 7. As shown in FIG. 3, the swivel bracket 5 has a pair of lugs 6 through which the aforementioned pin 7 is passed.

The swivel bracket 5 has a substantially vertically extending bore 5a for accommodating a mounting shaft secured to the driving assembly 8 of the propulsion unit. Thus, the driving assembly 8 is swingable horizontally about the axis of the bore 5a. In the driving assembly 8, there is supported an engine unit 9 and a propeller 10 driven by the engine unit 9. The driving assembly 8 is also provided with a handle 11 for moving the driving assembly 8 about the axis of the bore 5a to stear the boat.

Figure 4:
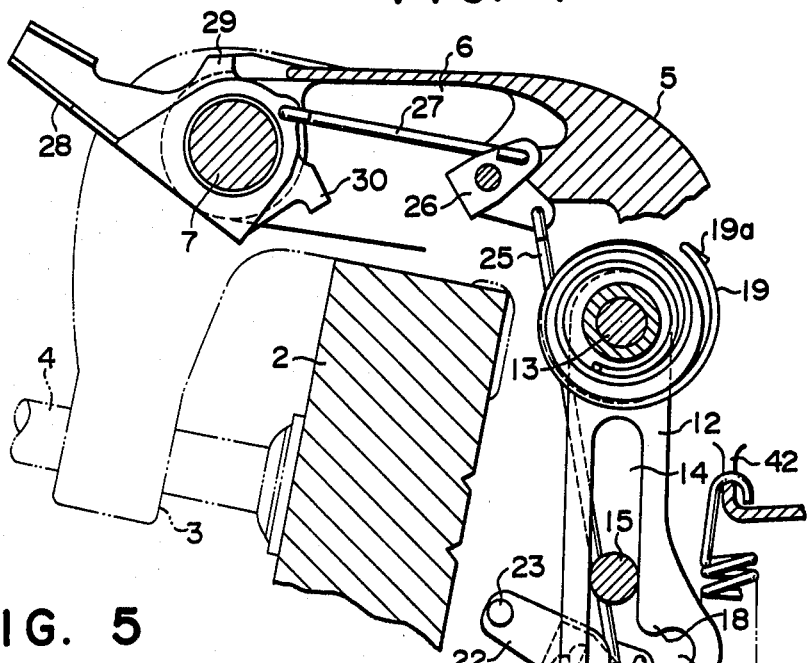
FIG. 4 is an enlarged view of the tilt lock and reverse lock mechanisms employed in the unit.

Between the clamp bracket 3 and the swivel bracket 5, there is provided a tilt lock mechanism 20 and a reverse lock mechanism 34. The tilt lock mechanism 20 comprises a locking member 12 pivotably mounted by means of a shaft 13 on the inner side wall of the clamp bracket 3. As shown in FIG. 4, the locking member 12 is formed with an elongated slot 14. At one end or the end of the slot 14 adjacent to the free end of the locking member 12, there is formed a locking recess 17 which extends angularly with respect to the slot 14 so as to form a substantially L-shaped slot together with the slot 14. At the junction of the slot 14 and the recess 17, there is formed a projection or retaining ridge 18.

A locking pin 15 is provided on the swivel bracket 5 and in slidable engagement with the slot 14 in the locking member 12. Around the shaft 13, there is disposed a torsion spring 19 having one end secured to the clamp bracket. The other end 19a of the spring 19 is free but formed as a hook so that it is engageable with the locking member 12 when the latter is rotated counterclockwise from the position shown in FIG. 4.

Figure 6:
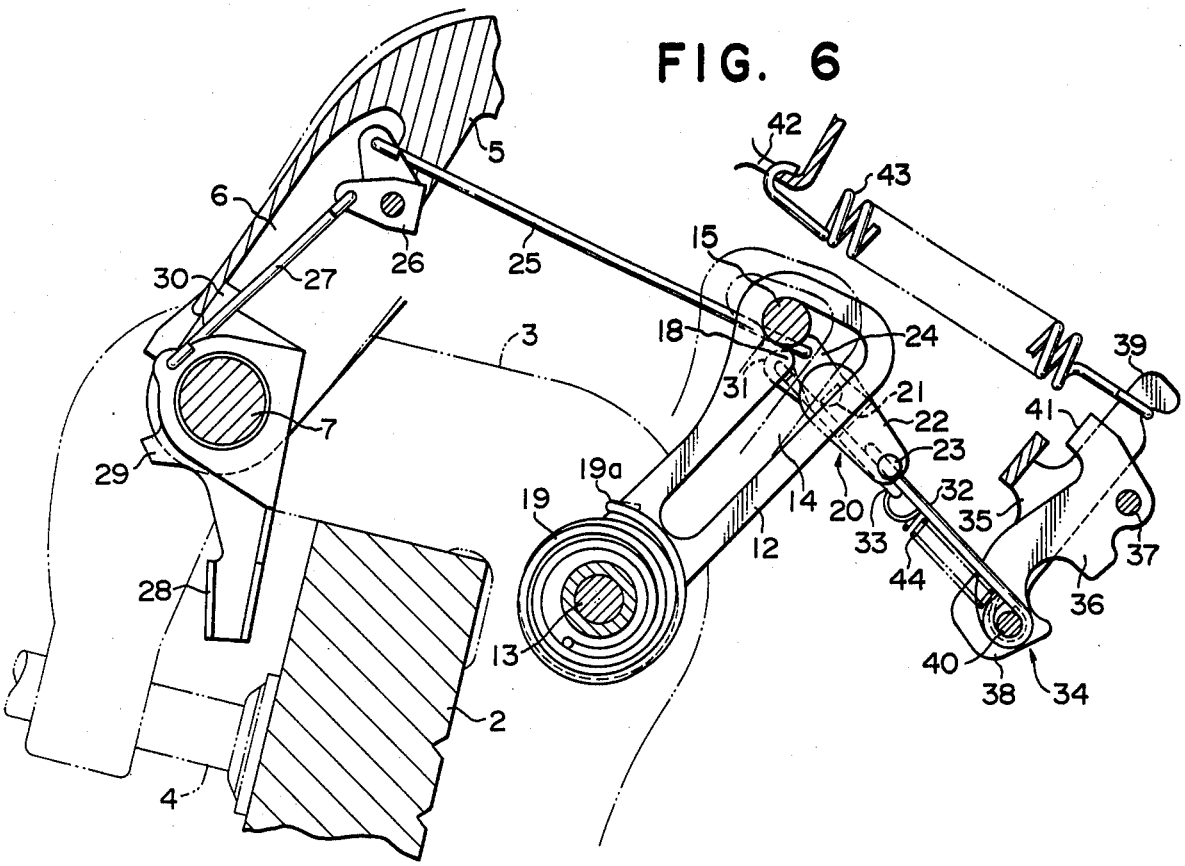
FIG. 6 is a view similar to FIGS. 4 and 5 but showing the parts in the tilt lock position.

It will be understood, that, when the swivel bracket 5 is moved about the pin 7 upwardly with respect to the clamp bracket 3, the locking pin 15 is moved along a circular path about the pin 7 while the shaft 13 is maintained stationary. Thus, in the course of the upward movement of the swivel bracket 5, the locking pin 15 is moved along the slot 14 and finally reaches the end of the slot 14 where the recess 17 is formed. During the movement, the locking member 12 is also rotated by the locking pin 15 to a position where the hooked end 19a of the spring 19 engages the member 12. Thus, the locking member 12 has already been brought by this moment under the biasing influence of the spring 19 so that, as soon as the locking pin 15 reaches the aforementioned end of the slot 14, the locking member 12 is rotated clockwise to bring the recess 17 into engagement with the locking pin 15 as shown in FIG. 6.

In order to control the movement of the locking member 12, the tilt lock mechanism 20 further includes a control lever 22 which is mounted at one end rotatably on the swivel bracket 5 by means of a shaft 21. It should be noted that the shaft 21 is located for distant from the shaft 13 for the purpose which will be made clear later. In the illustrated embodiment, the shaft 21 is located with a greater distance than the locking pin 15 from the shaft 13. The control lever 22 is provided with a stop pin 23 mounted on the other end. An arm 24 is attached to the shaft 21 and rotatable with the control lever 22 and extends in the direction opposite to the end of the control lever 22 to which the pin 23 is mounted. The arm 24 is connected through a push-pull rod 25 with a bellcrank 26 which is mounted on the swivel bracket 5 and connected through a rod 27 with an operating lever 28. The operating lever 28 is mounted rotatably on the pin 7 and has projections 29 and 30 which are adapted to engage a top wall of the lugs 6 of the swivel bracket 5 so as to determined the angular travel of the lever 28.

It will be seen that when the lever 28 is in the position shown in FIG. 4, the pin 23 on the control lever 22 is in a position engageable with the intermediate portion of the locking member 12 as the member 12 is swung counterclockwise with respect to the clamp bracket 3. When the operating lever 28 is shifted to the position shown in FIG. 5, the movement of the lever 28 is transmitted through the rod 27, the bellcrank 26 and the push-pull rod 25 to the arm 24 so as to rotate the control lever 22 counterclockwise. Thus, the pin 23 is retracted from the area of the swinging movement of the locking member 12.

The reverse lock mechanism 34 includes a reverse lock lever 36 which is mounted at one end pivotably on the swivel bracket 5 by means of a pin 37. A second lever 35 is pivotably attached at its one end 38 to the free end of the lever 36 by means of a pin 40. The other end 39 of the second lever 35 is engaged with a coil spring 43 which is extending between a bracket portion 42 formed on the swivel bracket 5 and said end 39 of the lever 35. The first reverse lock lever 36 is formed with a hook 41 at its upper edge so that, when the second lever 35 is subjected to the force of the spring 43, the lever 35 and 36 rotate as a unit about the pin 37.

The lever 35 is formed at the end 38 with a hook portion 35a which is adapted to engage a reverse lock rod 45 provided on the clamp bracket 3. The hook portion 35a is normally urged under the influence of the spring 43 into locking engagement with the reverse lock rod 45. It is, however, so shaped that, when the swivel bracket 5 is subjected to a reverse thrust exceeding a predetermined value, it is disengaged frm the rod 45 overcoming the force of the spring 43.

The control lever 22 has a second arm 31 which is secured to the shaft 21 and rotatable with the arm 24. The arm 31 is angularly offset with respect to the arm 24 in the counterclockwise direction about the shaft 21. The arm 31 is connected with the levers 35 and 36 by means of a tension rod 32 extending between the arm 31 and the pin 40. The tension rod 32 is formed with a loop 33 to which one end of a tension spring 44 engages, the other end of the spring being in engagement with the pin 40.

In operation, the operating lever 2B is positioned as shown in FIG. 4 and therefore the stop pin 23 is in the operative position. Further, the reverse lock levers 35 and 36 are in the locking position as shown.

Figure 5:
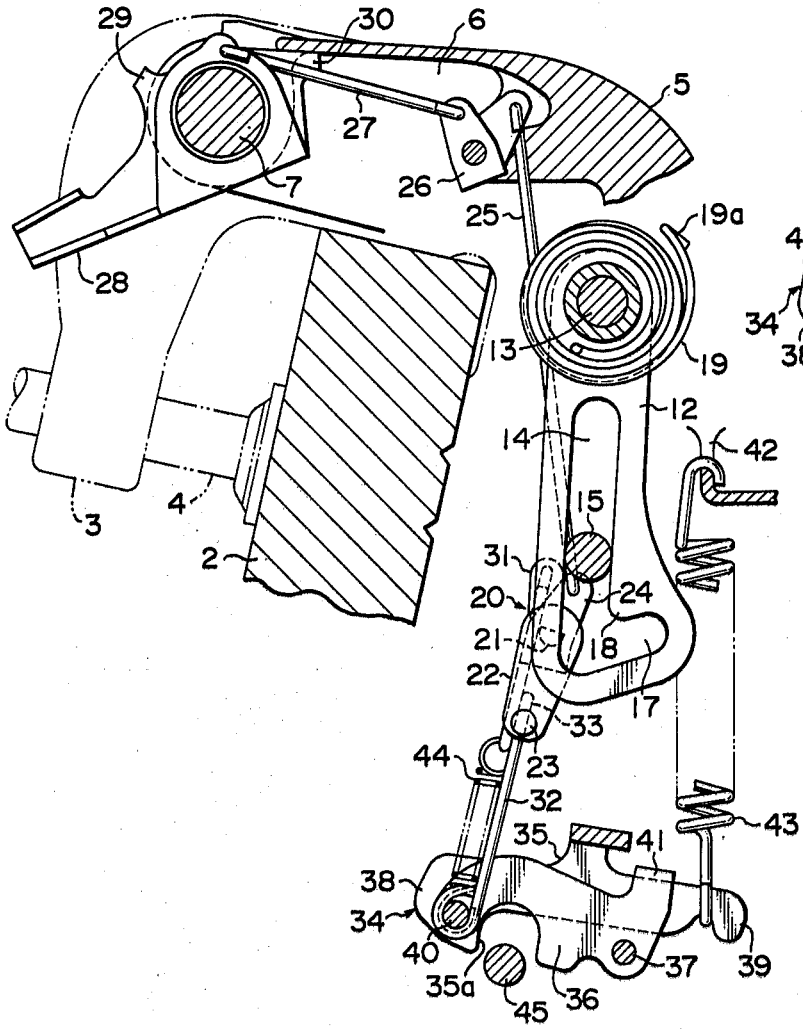
FIG. 5 is a view of the mechanism similar to FIG. 4 but showing the parts in the reverse lock release position.

When it is desired to raise the propulsion unit to the tilt lock position, the operating lever 28 is rotated counterclockwise until the projection 30 engages the stop wall of the lugs 6 of the swivel bracket 5 as shown in FIG. 5. Thus, the lever 22 and the pin 23 carried thereon are moved to the inoperative position. At the same time, the tension rod 32 pulls the pin 40 upward so that the hook portion 35a is disengaged from the reverse lock rod 45. It should be noted herein that the line of the tension force acting through the rod 32 moves from right side to the left side of the shaft 21 so that the force of the spring 43 no longer serves to return the arm 31 and the lever 22 clockwise to the position shown in FIG. 4.

Then, the driving assembly 8 of the propulsion unit is raised about the pin 7. As the driving assembly 8 is raised and therefore the swivel bracket 5 is rotated counterclockwise, the tilt lock pin 15 is also moved along the circular path about the pin 7. Thus, the pin 15 is slidably moved along the slot 14 and, when the swivel bracket 5 is raised to the tilt lock position, the pin 15 reaches the outer end of the slot 14. By this time, the free end 19*a* of the spring 19 is brought into engagement with the locking member 12 so as to bias the member 12 clockwise. Therefore, as soon as the pin 15 overrides the retaining ridge 18 of the recess 17, the locking member 12 is moved under the influence of the spring 19 clockwise to bring the pin 15 into engagement with the locking recess 17 as shown in FIG. 6. Then, the driving assembly 8 may be released and it will be maintained at the raised position.

In order to lower the driving assembly 8, the operating lever 28 is at first returned to the position shown in FIG. 4 and the driving assembly 8 is then lifted by a small distance. Through the above actuation of the operating lever 28, the control lever 22 is rotated clockwise so that the biasing force of the spring 43 acts along a line rightside of the shaft 21. Thus, the control lever 22 is now biased clockwise by the spring 43 and rotated until the pin 23 engages the locking member 12. Since the projection 29 on the operating lever 28 is located with a certain space with respect to the top wall of the swivel bracket 5 when it is manually returned, the aforementioned movement of the control lever 22 is permitted.

It should be noted herein that the distance between the shaft 13 and the point where the pin 23 engages the locking member 12 is large in relation to that between the shaft 13 and the point where the end 19*a* of the spring 19 engages the locking member 12, so that the locking member 12 is rotated counterclockwise under the force of the spring 43 against the action of the spring 19 to cause disengagement of the recess 17 from the pin 15. Thus, the driving assembly 8 can be lowered without any disturbance and locked in the lowered position by the reverse lock mechanism 34.

Figure 7:
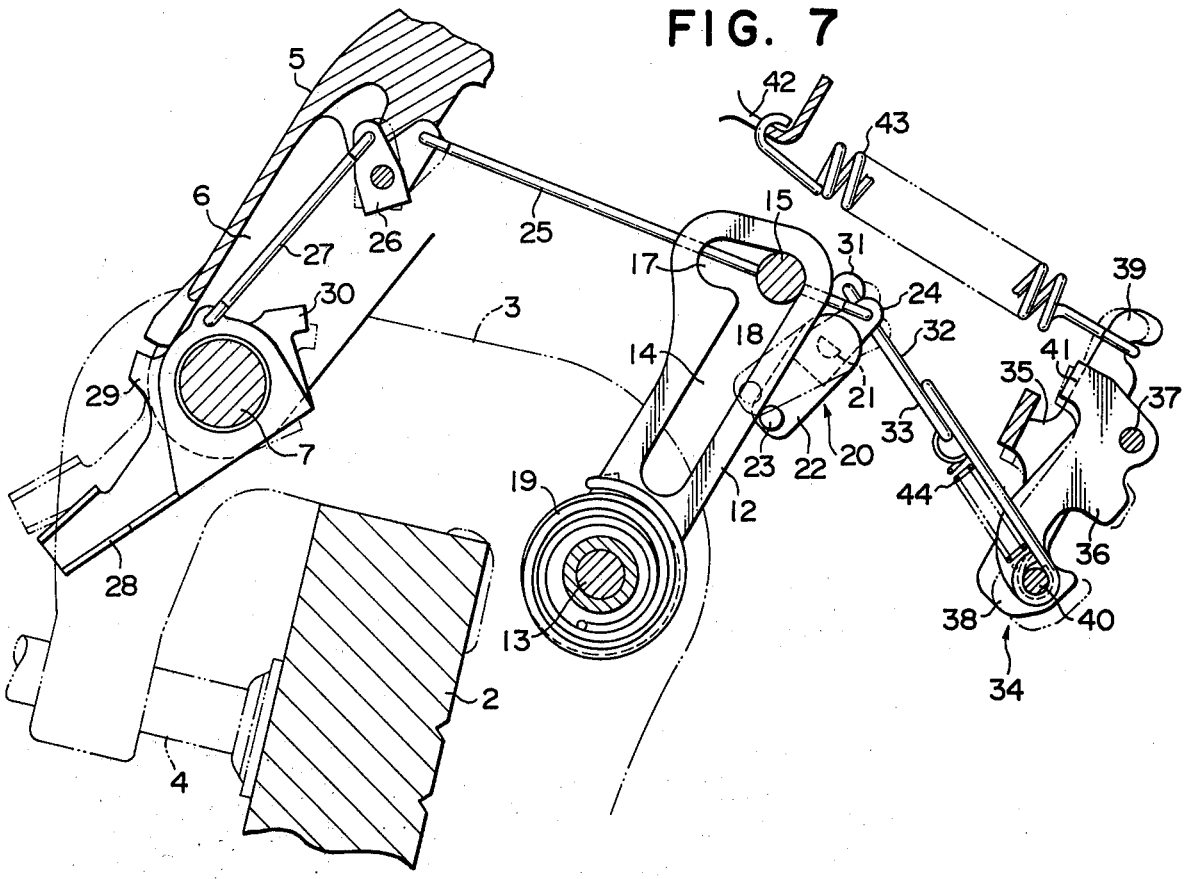
FIG. 7 is a view showing the function of the tilt lock mechanism when the unit is jumped up to the height of the raised position from the normal operating position.

When the unit is operating in the position shown in FIG. 4 and subjected to a strong reverse thrust for example by colliding at a floating log, the unit may be jumped up to a height equivalent to the tilt lock position. Since the control lever 22 and the stop pin 23 are maintained at the operative position, the locking member 12 is prevented by the pin 23 from rotating clockwise under the influence of the spring 19 even when the pin 15 reaches the outer end of the slot 14 as shown in FIG. 7. Therefore, the pin 15 is not brought into engagement with the locking recess 17 and the driving assembly 8 can be returned to the lowered position.

From the above description, it will be understood that the objects of the present invention can be accomplished by the structures described. Although the invention has thus been shown and described with respect to a specific embodiment, it should be noted that the invention is in no way limited to the details of the illustrated structures but changes and modifications may be made without departing from the scope of the appended claims.

I claim:

1. Outboard marine propulsion unit comprising clamp bracket means adapted to be secured to a boat hull, swivel bracket means pivotably mounted about an axis on said clamp means, and carrying a propulsion unit, tilt lock means for holding said swivel bracket means in a position raised with respect to a normal operating position, said tilt lock means including locking member means pivotably mounted on one of the clamp bracket means and the swivel bracket means and having elongated slot means, said slot means being formed at one end with locking recess means offset to one side of the slot means, locking pin means provided on the other of said clamp bracket means and said swivel bracket means and slidably engaging said slot means, biasing means for engaging said locking member means at a point for applying thereto a biasing force in such a direction that the locking recess means is forced into engagement with the locking pin means when the swivel bracket means is moved to the raised position and the locking pin means is slidably moved along the slot means to the end where the locking recess means is formed, restricting means adapted to engage said locking member means for applying thereto a biasing force which is larger than but opposite to the biasing force of the biasing means for restricting said locking member means against the movement under the biasing means, and control means for moving said restricting means into and from a position where the restricting means is engageable with said locking member means, said biasing means being independent from said restricting means and said control means so that said biasing means can always apply a biasing force to said locking member.

2. The propulsion unit in accordance with claim 1 in which said restricting means includes a control lever rotatably mounted on said swivel bracket means and a stop pin provided on said lever for engagement with said locking member means.

3. The propulsion unit in accordance with claim 2 in which said control means includes an operating lever pivotably mounted about an axis coaxial with the pivot axis of the swivel bracket, said operating lever being connected with the control lever so that the latter lever can be rotated by the former lever.

4. The propulsion unit in accordance with claim 1 in which said biasing means includes a torsion spring which engages the locking member means when the swivel bracket means has raised by a predetermined distance.

5. The propulsion unit in accordance with claim 1 which further includes reverse lock means for holding the swivel bracket means in the normal operating position.

6. The propulsion unit in accordance with claim 5 in which said control means is interconnected with the reverse lock means in such a manner that, when the restricting means is moved into the position where it is engageable with said locking member means, said reverse lock means is moved to lock position.

7. The propulsion unit in accordance with claim 5 in which the reverse lock means is so formed that it is overridden by a reverse thrust beyond a predetermined value.

8. The propulsion unit in accordance with claim 1 in which said restricting means being so located that it engages said locking member means at a position more distant from the axis of pivot movement of the locking member than the point where the biasing means engages the locking member means.

9. Outboard marine propulsion unit comprising clamp bracket means adapted to be secured to a boat hull, swivel bracket means pivotably mounted about an axis on said clamp bracket means, and carrying a propulsion unit, tilt lock means for holding said swivel bracket means in a position raised with respect to a normal operating position, said tilt lock means including locking member means pivotably mounted on one of the clamp bracket means and the swivel bracket means and having elongated slot means, said slot means being formed at one end with locking recess means offset to one side of the slot means, locking pin means provided on the other of said clamp bracket means and said swivel bracket means and slidably engaging said slot means, means for biasing locking member means in such a direction that the locking recess means is forced into engagement with the locking pin means when the swivel bracket means is moved to the raised position and the locking pin means is slidably moved along the slot means to the end where the locking recess means is formed, restricting means including a control lever rotatably mounted on said swivel bracket means and a stop pin provided on said lever for engagement with said locking member means for restricting said locking member means against the movement under the biasing means, and control means for moving said restricting means into and from a position where the restricting means is engageable with said locking member means, said control means including an operating lever pivotably mounted about an axis coaxial with the pivot axis of the swivel bracket, said operating lever being connected with the control lever so that the latter lever can be rotated by the former lever.

10. Outboard marine propulsion unit comprising clamp bracket means adapted to be secured to a boat hull, swivel bracket means pivotably mounted about an axis on said clamp bracket means, and carrying a propulsion unit, tilt lock means for holding said swivel bracket means in a position raised with respect to a normal operating position, said tilt lock means including locking member means pivotably mounted on one of the clamp bracket means and the swivel bracket means and having elongated slot means, said slot means being formed at one end with locking recess means offset to one side of the slot means, locking pin means provided on the other of said clamp bracket means and said swivel bracket means and slidably engaging said slot means, means for biasing locking member means in such a direction that the locking recess means is forced into engagement with the locking pin means when the swivel bracket means is moved to the raised position and the locking pin means is slidably moved along the slot means to the end where the locking recess means is formed, said biasing means including a torsion spring which engages the locking member means when the swivel bracket means has raised by a predetermined distance, restricting means adapted to engage said locking member means for restricting said locking member means against the movement under the biasing means, and control means for moving said restricting means into and from a position where the restricting means is engageable with said locking member means.

* * * * *